US009688465B2

(12) United States Patent
Trombetta et al.

(10) Patent No.: US 9,688,465 B2
(45) Date of Patent: Jun. 27, 2017

(54) BEVERAGE CAPSULE AND PROCESS AND SYSTEM FOR MAKING SAME

(71) Applicant: 2266170 Ontario Inc., Mississauga (CA)

(72) Inventors: Liberatore A. Trombetta, Ancaster (CA); YuCheng Fu, Mississauga (CA)

(73) Assignee: 2266170 ONTARIO INC., Mississauga, ON (CA)

( * ) Notice: Subject to any disclaimer, the term of this patent is extended or adjusted under 35 U.S.C. 154(b) by 135 days.

(21) Appl. No.: 14/077,356

(22) Filed: Nov. 12, 2013

(65) Prior Publication Data

US 2014/0141128 A1 May 22, 2014

Related U.S. Application Data

(60) Provisional application No. 61/725,324, filed on Nov. 12, 2012.

(51) Int. Cl.
*B65B 29/02* (2006.01)
*B65B 31/04* (2006.01)
(Continued)

(52) U.S. Cl.
CPC ..... *B65D 85/8046* (2013.01); *B65B 1/02* (2013.01); *B65D 85/8043* (2013.01)

(58) Field of Classification Search
CPC ..... B65B 29/00; B65B 29/02; B65B 29/06; B65B 29/10; B65B 7/2842; B65B 29/04;
(Continued)

(56) References Cited

U.S. PATENT DOCUMENTS 2,113,715 A 4/1938 Wilcox
2,987,221 A 6/1961 Milton
(Continued)

FOREIGN PATENT DOCUMENTS

CA 2012891 9/1991
CA 2516417 A1 9/2004
(Continued)

OTHER PUBLICATIONS

Office Action in CA 2833096 dated May 4, 20015.
(Continued)

*Primary Examiner* — Andrew M Tecco
*Assistant Examiner* — Praachi M Pathak
(74) *Attorney, Agent, or Firm* — Manelli Selter PLLC; Edward J. Stemberger

(57) ABSTRACT

A beverage capsule is provided for use in a beverage preparing machine. A system and process for making the beverage capsule is also provided. The beverage capsule includes a body defining an interior space having an opening. A filter is disposed in the body to define an ingredients chamber and an extraction chamber. The filter has an air flow permeability of at least 400 L/s·m2. Ingredients are disposed in the ingredients chamber and a cover is dispensed over the opening to seal the interior space. The filter includes a vent region between the top surface of the ingredients and the bottom surface of cover for venting gas through said filter between said ingredients chamber and said extraction chamber. An alternate embodiment includes air flow channels defined in a side wall of body.

19 Claims, 6 Drawing Sheets

(51) Int. Cl.
*B65D 85/00* (2006.01)
*B65B 1/02* (2006.01)
*B65D 85/804* (2006.01)

(58) Field of Classification Search
CPC ..... B65B 31/00; B65B 31/04; B65B 7/2878; B65D 85/00; B65D 85/804; B65D 85/8043; B65D 85/8046
USPC ..... 53/249, 284.2, 284.7, 329, 329.3, 373.2, 53/79, 403, 428, 432, 473, 476, 510, 511, 53/281, 154, 155, 237, 238, 240, 329.2; 426/77–84, 115, 316, 320, 394; 99/275, 99/295
IPC ..... B65D 85/00,85/804, 85/8043, 85/8046
See application file for complete search history.

(56) References Cited

U.S. PATENT DOCUMENTS 3,110,121 A 11/1963 Corrinet
3,282,703 A 11/1966 Broadhurst
3,399,806 A 9/1968 Lucas
3,713,936 A 1/1973 Ramsay
3,748,819 A * 7/1973 Christensson ..... B65B 43/50 53/527
4,101,627 A 7/1978 Menier
4,131,064 A 12/1978 Ryan et al.
4,220,673 A 9/1980 Strobel
4,235,160 A 11/1980 Olney et al.
4,306,367 A 12/1981 Otto
4,440,796 A 4/1984 Lunder et al.
4,471,689 A 9/1984 Piana
4,518,639 A 5/1985 Phillips
4,559,729 A 12/1985 White
4,619,830 A 10/1986 Napier
4,624,099 A * 11/1986 Harder ..... B65B 31/043 53/282
4,701,365 A 10/1987 Iwasaki
4,728,425 A 3/1988 Sandvig
4,859,337 A 8/1989 Woltermann
4,865,737 A 9/1989 McMichael
4,867,993 A 9/1989 Nordskog
4,882,055 A * 11/1989 Stamstad ..... B01D 29/111 210/483
4,981,588 A 1/1991 Poulallion
4,983,410 A 1/1991 Dinos
4,995,310 A 2/1991 van der Lijn et al.
4,996,066 A 2/1991 Love et al.
5,008,013 A 4/1991 Favre et al.
5,012,629 A * 5/1991 Rehman ..... B65B 29/02 206/0.5
5,020,303 A * 6/1991 Vokins ..... B65B 55/025 426/399
5,076,433 A 12/1991 Howes
5,195,298 A * 3/1993 Baranowski ..... B65B 55/02 156/281
5,298,267 A 3/1994 Gruenbacher
5,325,765 A * 7/1994 Sylvan ..... A47J 31/0673 426/433
5,331,793 A 7/1994 Pophal et al.
5,390,587 A 2/1995 Wu
5,447,631 A 9/1995 Mahlich
5,456,929 A 10/1995 Mifune et al.
5,472,719 A * 12/1995 Favre ..... A47J 31/0673 426/112
5,496,573 A 3/1996 Tsuji et al.
5,536,290 A 7/1996 Stark et al.
5,575,383 A 11/1996 Seeley
5,601,716 A 2/1997 Heinrich et al.
5,605,710 A 2/1997 Pridonoff et al.
5,738,786 A 4/1998 Winnington-Ingram
5,806,852 A 9/1998 Howes
5,840,189 A 11/1998 Sylvan et al.
5,858,437 A 1/1999 Anson
5,866,185 A 2/1999 Burkett
5,871,096 A 2/1999 Yakich
5,871,644 A 2/1999 Simon et al.
5,882,716 A 3/1999 Munz-Schaerer et al.
5,885,314 A 3/1999 Oussoren et al.
5,895,672 A 4/1999 Cooper
5,896,686 A 4/1999 Howes
5,897,899 A 4/1999 Fond
5,923,242 A 7/1999 Slagle et al.
5,941,055 A * 8/1999 Coates ..... B65B 29/06 425/112
5,957,279 A 9/1999 Howes
5,971,195 A 10/1999 Reidinger et al.
6,025,000 A 2/2000 Fond et al.
6,079,315 A * 6/2000 Beaulieu ..... A47J 31/3628 99/289 R
6,146,270 A 11/2000 Huard et al.
6,189,438 B1 2/2001 Bielfeldt et al.
6,220,147 B1 4/2001 Priley
6,223,937 B1 5/2001 Schmidt
6,440,256 B1 8/2002 Gordon et al.
6,514,555 B1 2/2003 Fayard et al.
6,548,433 B1 4/2003 Gbur et al.
6,557,597 B2 5/2003 Riesterer
6,561,232 B1 5/2003 Frutin
6,589,577 B2 7/2003 Lazaris et al.
6,607,762 B2 8/2003 Lazaris et al.
6,622,615 B2 9/2003 Heczko
6,644,173 B2 11/2003 Lazaris et al.
6,645,537 B2 11/2003 Sweeney et al.
6,658,989 B2 12/2003 Sweeney et al.
6,720,070 B2 4/2004 Hamaguchi et al.
6,758,130 B2 7/2004 Sargent et al.
6,810,788 B2 11/2004 Hale
6,841,185 B2 1/2005 Sargent et al.
6,854,378 B2 2/2005 Jarisch et al.
6,869,627 B2 3/2005 Perkovic et al.
6,913,777 B2 7/2005 Rebhorn et al.
6,959,832 B1 11/2005 Sawada
6,992,586 B2 1/2006 Rosenfeld
7,067,038 B2 6/2006 Trokhan et al.
7,153,530 B2 12/2006 Masek et al.
7,279,188 B2 10/2007 Arrick et al.
7,311,209 B2 12/2007 Bentz et al.
7,328,651 B2 2/2008 Halliday et al.
7,387,063 B2 6/2008 Vu et al.
7,412,921 B2 8/2008 Hu et al.
7,490,542 B2 2/2009 Macchi et al.
7,543,527 B2 6/2009 Schmed
7,552,672 B2 6/2009 Schmed
7,552,673 B2 6/2009 Levin
7,594,470 B2 9/2009 Scarchilli et al.
7,624,673 B2 12/2009 Zanetti
7,640,842 B2 1/2010 Bardazzi
7,681,492 B2 3/2010 Suggi et al.
7,685,930 B2 3/2010 Mandralis et al.
7,763,300 B2 7/2010 Sargent et al.
7,798,055 B2 9/2010 Mandralis et al.
7,854,192 B2 12/2010 Denisart et al.
7,856,920 B2 12/2010 Schmed et al.
7,856,921 B2 12/2010 Arrick et al.
7,910,145 B2 3/2011 Reati
8,062,682 B2 11/2011 Mandralis et al.
8,225,711 B1 7/2012 Andre
8,230,775 B2 * 7/2012 Vanni ..... B65D 85/8043 426/394
8,286,547 B1 10/2012 Lassota
8,361,527 B2 * 1/2013 Winkler ..... A47J 31/3695 426/77
8,409,646 B2 4/2013 Yoakim et al.
8,425,957 B2 4/2013 Steenhof
8,474,368 B2 7/2013 Kilber et al.
8,475,854 B2 7/2013 Skalski et al.
8,481,097 B2 7/2013 Skalski et al.
8,573,114 B2 11/2013 Huang et al.
8,591,978 B2 11/2013 Skalski et al.
8,673,379 B2 3/2014 Skalski et al.
8,740,020 B2 6/2014 Marina et al.
8,834,948 B2 9/2014 Estabrook et al.

(56) References Cited

U.S. PATENT DOCUMENTS 8,960,078 B2 2/2015 Hristov et al.
9,149,147 B2 * 10/2015 Perentes ..... A47J 31/22
2002/0020659 A1 2/2002 Sweeney et al.
2003/0005826 A1 1/2003 Sargent et al.
2003/0039731 A1 2/2003 Dalton et al.
2003/0087005 A1 5/2003 Baron
2004/0045443 A1 * 3/2004 Lazaris ..... B65D 85/8043 99/279
2005/0016383 A1 1/2005 Kirschner et al.
2005/0051478 A1 3/2005 Karanikos et al.
2005/0287251 A1 12/2005 Lazaris et al.
2006/0236871 A1 10/2006 Ternite et al.
2006/0246187 A1 11/2006 Egolf et al.
2007/0144356 A1 6/2007 Rivera
2007/0148290 A1 6/2007 Ternite
2007/0259074 A1 * 11/2007 Searchilli ..... B65D 85/8043 426/78
2007/0275125 A1 11/2007 Catani
2008/0015098 A1 1/2008 Littlejohn et al.
2008/0142115 A1 6/2008 Vogt et al.
2008/0156196 A1 7/2008 Doglioni et al.
2008/0202075 A1 8/2008 Kronawittleithner et al.
2008/0245236 A1 10/2008 Ternite et al.
2008/0299262 A1 * 12/2008 Reati ..... B26F 1/40 426/84
2008/0314256 A1 * 12/2008 Smith ..... B65D 85/816 99/298
2009/0110775 A1 4/2009 Rijskamp et al.
2009/0133584 A1 5/2009 De Graaff et al.
2009/0165228 A1 7/2009 Kilkenny
2009/0173043 A1 * 7/2009 Bloome ..... B29C 65/18 53/416
2009/0175986 A1 7/2009 Doglioni
2009/0186141 A1 7/2009 Almblad et al.
2009/0206084 A1 8/2009 Woolf et al.
2009/0211458 A1 8/2009 Denisart et al.
2009/0260690 A1 10/2009 Bell
2009/0311389 A1 12/2009 Zoss et al.
2009/0324791 A1 12/2009 Ohresser et al.
2010/0003379 A1 1/2010 Zoss et al.
2010/0028495 A1 2/2010 Novak et al.
2010/0116772 A1 5/2010 Teys
2010/0215808 A1 8/2010 Versini
2010/0239733 A1 9/2010 Yoakim et al.
2010/0263329 A1 10/2010 Nash
2010/0288131 A1 * 11/2010 Kilber ..... B65D 85/8043 99/295
2010/0303964 A1 12/2010 Beaulieu et al.
2011/0003040 A1 1/2011 Graf et al.
2011/0033580 A1 2/2011 Biesheuvel et al.
2011/0045144 A1 2/2011 Boussemart et al.
2011/0076361 A1 * 3/2011 Peterson ..... B65D 85/8043 426/79
2011/0183048 A1 7/2011 Noble et al.
2011/0185911 A1 8/2011 Rapparini
2011/0247975 A1 10/2011 Rapparini
2011/0305801 A1 * 12/2011 Beer ..... B65D 85/8043 426/77
2012/0006205 A1 1/2012 Vanni
2012/0024160 A1 2/2012 Van et al.
2012/0052163 A1 3/2012 Doleac et al.
2012/0070542 A1 3/2012 Camera et al.
2012/0097602 A1 4/2012 Tedford
2012/0121764 A1 5/2012 Lai et al.
2012/0171334 A1 7/2012 Yoakim
2012/0174794 A1 7/2012 Fraij
2012/0180670 A1 7/2012 Yoakim
2012/0180671 A1 7/2012 Baudet
2012/0183649 A1 7/2012 Burkhalter
2012/0186457 A1 7/2012 Ozanne
2012/0196008 A1 8/2012 York
2012/0199007 A1 8/2012 Larzul
2012/0199010 A1 8/2012 Mariller
2012/0199011 A1 8/2012 Cheng
2012/0201933 A1 8/2012 Dran et al.
2012/0207893 A1 8/2012 Kreuger
2012/0207894 A1 8/2012 Webster
2012/0210876 A1 8/2012 Glucksman
2012/0210878 A1 8/2012 Mariller
2012/0210879 A1 8/2012 Mariller
2012/0231123 A1 9/2012 Kamerbeek
2012/0231124 A1 9/2012 Kamerbeek
2012/0231126 A1 9/2012 Lo Faro
2012/0231133 A1 9/2012 Kamerbeek
2012/0251668 A1 10/2012 Wong
2012/0251669 A1 10/2012 Kamerbeek
2012/0251670 A1 10/2012 Kamerbeek
2012/0251671 A1 10/2012 Kamerbeek
2012/0251692 A1 10/2012 Kamerbeek
2012/0251693 A1 10/2012 Kamerbeek
2012/0251694 A1 10/2012 Kamerbeek
2012/0258204 A1 10/2012 Tsuji
2012/0258210 A1 10/2012 Wong
2012/0258219 A1 10/2012 Wong
2012/0258221 A1 10/2012 Wong
2012/0260806 A1 10/2012 Rolfes
2012/0263829 A1 10/2012 Kamerbeek
2012/0263830 A1 10/2012 Kamerbeek
2012/0263833 A1 10/2012 Wong
2012/0266755 A1 10/2012 Baudet
2012/0269933 A1 10/2012 Rapparini
2012/0272830 A1 11/2012 Gugerli
2012/0276252 A1 11/2012 Bunke
2012/0276255 A1 11/2012 Verbeek
2012/0297987 A1 11/2012 Lee
2012/0301581 A1 11/2012 Abegglen
2012/0307024 A1 12/2012 Howes
2012/0308688 A1 * 12/2012 Peterson ..... A47J 31/002 426/86
2012/0312174 A1 12/2012 Lambert
2012/0321755 A1 12/2012 Macaulay
2012/0321756 A1 12/2012 Estabrook et al.
2012/0328739 A1 12/2012 Nocera
2012/0328740 A1 12/2012 Nocera
2012/0328744 A1 12/2012 Nocera
2013/0004629 A1 1/2013 Clark
2013/0004637 A1 1/2013 Gugerli
2013/0008316 A1 1/2013 Hoeglauer
2013/0011521 A1 1/2013 Weijers et al.
2013/0017303 A1 1/2013 Vu
2013/0025466 A1 1/2013 Fu
2013/0032034 A1 2/2013 Jarisch
2013/0047863 A1 2/2013 Larzul
2013/0055903 A1 3/2013 Deuber
2013/0059039 A1 3/2013 Trombetta
2013/0068109 A1 3/2013 Pribus et al.
2013/0084368 A1 4/2013 Linck et al.
2013/0095212 A1 * 4/2013 Beer ..... B65D 85/8043 426/80
2013/0095219 A1 4/2013 de Graaff et al.
2013/0115342 A1 5/2013 Van et al.
2013/0122153 A1 5/2013 Ferrier et al.
2013/0122167 A1 5/2013 Winkler et al.
2013/0142931 A1 6/2013 Fin et al.
2013/0259982 A1 10/2013 Abegglen et al.
2013/0340626 A1 12/2013 Oh
2013/0344205 A1 12/2013 Oh
2014/0013958 A1 1/2014 Krasne et al.
2014/0037802 A1 2/2014 Cardoso
2014/0099388 A1 4/2014 Wang et al.
2014/0141128 A1 * 5/2014 Trombetta ..... B65B 1/02 426/77
2014/0178538 A1 * 6/2014 Husband ..... A47J 31/446 426/115
2014/0220191 A1 * 8/2014 Kelly ..... B65D 85/8043 426/115
2014/0230370 A1 * 8/2014 Bianchi ..... B65B 29/02 53/410
2015/0050391 A1 2/2015 Rapparini
2015/0056341 A1 * 2/2015 Trombetta ..... B65D 85/8043 426/115

(56) References Cited

U.S. PATENT DOCUMENTS

| | | | | |
|---|---|---|---|---|
| 2015/0110928 | A1* | 4/2015 | Kihnke | A47J 31/0668 426/110 |
| 2015/0128525 | A1* | 5/2015 | Bartoli | B65B 29/02 53/410 |
| 2015/0175347 | A1* | 6/2015 | Empl | A23C 9/1508 426/433 |
| 2015/0197354 | A1* | 7/2015 | Scrivani | B65B 7/2842 53/476 |
| 2015/0225099 | A1* | 8/2015 | Villain | B65B 29/02 426/115 |
| 2015/0239652 | A1* | 8/2015 | Trombetta | A23F 5/08 426/115 |
| 2015/0314954 | A1* | 11/2015 | Empl | B65D 85/8043 426/115 |
| 2015/0314955 | A1* | 11/2015 | Savage | B65D 85/8046 426/115 |
| 2015/0359377 | A1* | 12/2015 | Graham | A47J 31/407 99/283 |

FOREIGN PATENT DOCUMENTS

| | | | | |
|---|---|---|---|---|
| CA | 2538256 | | 3/2005 | |
| CA | 2689804 | A1 | 3/2008 | |
| CA | 2686347 | A1 | 12/2008 | |
| CA | 2807489 | | 2/2012 | |
| CA | 2824199 | A1 | 8/2012 | |
| CA | 2759782 | A1 | 11/2012 | |
| CA | 2801236 | A1 | 3/2013 | |
| CY | 2484605 | A1 * | 8/2012 | A47J 31/3623 |
| EP | 0047169 | A2 | 3/1982 | |
| EP | 0145499 | | 6/1985 | |
| EP | 0432126 | A1 | 6/1991 | |
| EP | 0656/224 | A1 | 5/1994 | |
| EP | 1129623 | A1 | 9/2001 | |
| EP | 1859683 | | 11/2007 | |
| EP | 2230195 | | 9/2010 | |
| FR | 2930522 | A1 | 10/2009 | |
| GB | 803486 | A | 10/1958 | |
| GB | 962038 | | 6/1964 | |
| GB | 2074838 | | 11/1981 | |
| JP | 662737 | | 3/1994 | |
| JP | 11171249 | A | 6/1999 | |
| WO | 98/51396 | A1 | 11/1998 | |
| WO | 0145616 | A1 | 6/2001 | |
| WO | 03082065 | A1 | 10/2003 | |
| WO | 2004083071 | | 9/2004 | |
| WO | 2004083071 | A1 | 9/2004 | |
| WO | 2009114119 | | 9/2009 | |
| WO | 2010/007633 | A1 | 1/2010 | |
| WO | 2010013146 | A2 | 2/2010 | |
| WO | 2010066705 | A2 | 6/2010 | |
| WO | 2010085824 | | 8/2010 | |
| WO | 2011095518 | | 8/2010 | |
| WO | 201006516 | A1 | 9/2010 | |
| WO | 2010/137960 | A1 | 12/2010 | |
| WO | 2010137956 | A1 | 12/2010 | |
| WO | 2012/038063 | A1 | 3/2012 | |
| WO | 2012031106 | A1 | 3/2012 | |
| WO | 2012069505 | | 5/2012 | |
| WO | 2012/080501 | A1 | 6/2012 | |
| WO | 2013/029184 | A1 | 3/2013 | |

OTHER PUBLICATIONS

European Search report in EP 13192599.2-1708 issued on Mar. 21, 2014.

Opposition, EP2730523B1 in Application No. EP13192599.2, dated Jan. 9, 2017 and English translation thereof.

ASTM D737-04, Standard Test Method for Air Permeability of Textile Fabrics, Jan. 2005.

* cited by examiner

BEVERAGE CAPSULE AND PROCESS AND SYSTEM FOR MAKING SAME

FIELD

This specification relates to beverage capsules used in beverage preparing machines and in particular to multi-chamber beverage capsules and a process and system for making same.

BACKGROUND

The following background discussion is not an admission that anything discussed below is citable as prior art or common general knowledge. The documents listed below are incorporated herein in their entirety by this reference to them.

Single serve beverage capsules for use in beverage preparing machines are becoming increasingly popular. Such beverage capsules come in a variety of formats for producing beverages such as espresso coffee, drip coffee, tea or hot chocolate.

Single chamber beverage capsules, such as espresso capsules, have a single chamber defined by a plastic or aluminum body having a foil cover at one end. The chamber is densely packed with ingredients, such as ground coffee, for producing beverages in a high pressure beverage preparing machine. Hot water is injected under pressure by the beverage preparing machine into the single chamber containing the ingredients. As the pressure within the chamber increases the foil cover is forced against raised projections in the capsule holder to the point that the projections penetrate the cover so that the beverage flows through the cover into the user's cup.

One example of a single chamber beverage capsule is the Nespresso Grands Crus™ capsule. This capsule has an aluminum body with a foil cover. The foil cover is pierced by square protrusions in the capsule holder when hot water is injected under pressure by the beverage preparing machine into the capsule.

Multi chamber beverage capsules, such as drip coffee capsules, have a first chamber defined by a filter (typically a paper filter) that is loosely packed with ingredients (such as ground coffee) and a second chamber downstream of the first chamber that defines an empty space for receiving a prepared beverage that flows through the filter prior to dispensing into a cup.

One example of a multi chamber beverage capsule is the Keurig K-Cup™ capsule. This capsule includes a paper filter having a side wall that is sealed to an inside peripheral edge of the capsule. The side wall of the filter is pleated or fluted to define channels extending between the top and bottom of the filter. The channels are intended to improve fluid flow down the side wall of the chamber.

One advantage of single serve beverage capsules is that each serving contains a fresh supply of ingredients. The freshness of the ingredients is preserved through a modified atmosphere packaging (MAP) process where the air within the capsule is modified such as by replacing the air with an inert gas prior to sealing.

A problem with multi chamber beverage capsules is that a greater volume of air is contained within the capsule (in the second chamber and within the bed of loosely packed ingredients) which must be evacuated and replaced with an inert gas as part of the MAP process. The location and type of filter, such as the pleated paper filter that is secured to the side wall of the Keurig K-cup™ capsule, can restrict the rate at which air within the second chamber of the capsules may be evacuated and replaced with an inert gas. This significantly impacts the rate of production for conventional dual chamber capsules such as the Keurig K-cup™ capsules.

To address this problem, conventional dual chamber capsules, such as the Keurig K-cup™ capsule, are manufactured within a modified atmosphere environment. Specifically, the filling and sealing operations are conducted within an operation chamber in which the air has been replaced with nitrogen.

This results in manufacturing inefficiencies due to the large volumes of nitrogen required to fill the large space that houses the filling and sealing machinery. Furthermore, the operation requires a longer than desired lead time prior to each manufacturing cycle to replace the air within the operation chamber with nitrogen.

Another problem with conventional multi chamber capsules, such as the Keurig K-cup™ capsule, is that the brewing cycle is prolonged due to delayed balancing of the pressure differential between the upper and lower chambers during use of the beverage capsule in a beverage preparing machine.

There is a need for improvements to the beverage capsule and the process and system for making such beverage capsules to address problems such as noted above.

SUMMARY

In one aspect the invention provides a beverage capsule for use in a beverage preparing machine, the beverage capsule comprising:

a body defining an interior space;

a filter disposed in said body to define an ingredients chamber and an extraction chamber, said filter having an air flow permeability of at least 400 L/s·m2;

ingredients disposed in said ingredients chamber for preparing a desired consumable product; and a cover disposed over an opening to said body for sealing said interior space.

In another aspect the invention provides a beverage capsule for use in a beverage preparing machine, the beverage capsule comprising:

a body having a side wall extending from an end wall to an opening to define an interior space;

a plurality of air flow channels defined in an interior surface of said side wall of said body, said air flow channels extending at least partway between said opening and said end wall of said body;

a filter disposed in said body to define an ingredients chamber and an extraction chamber;

ingredients disposed in said ingredients chamber for preparing a desired consumable product; and a cover disposed over said opening for sealing said interior space.

In another aspect the invention provides a process for making a beverage capsule for use in a beverage preparing machine, the process comprising the steps of:

sealing a filter to a body for the beverage capsule to define an ingredients chamber and an extraction chamber, said filter having an air flow permeability of at least 400 L/s·m2; said body having a side wall extending from an end wall to an opening to define an interior space;

depositing a desired volume of desired ingredients into said ingredients chamber;

replacing a substantial volume of air within said interior space with an inert gas; and sealing a cover to said body to cover said opening.

In another aspect the invention provides a system for making a beverage capsule for use in a beverage preparing machine, the system comprising:

a filter sealing station for sealing a filter to a body for the beverage capsule to define an ingredients chamber and an extraction chamber, said filter having an air flow permeability of at least 400 L/s·m2, said body having a side wall extending from an end wall to an opening to define an interior space, said opening being surrounded by a flange;

a dosing station for depositing a desired volume of desired ingredients into said ingredients chamber;

a cover pre-sealing station for sealing a cover to said flange while maintaining at least one opening; and a MAP station for replacing a substantial volume of air within said body with an inert gas and sealing said at least one airflow opening with said cover.

In another aspect, the invention provides a capsule for use in a machine for preparing consumable products from capsules, the capsule comprising:

a body defining an interior space;

a filter disposed in said body to define an ingredients chamber and an extraction chamber, said filter having an air flow permeability of at least 400 L/s·m2;

ingredients disposed in said ingredients chamber for preparing a consumable product;

a cover disposed over an opening to said body for sealing said interior space; and wherein a vent region is defined in said filter between a top surface of said ingredients and a bottom surface of said cover, said vent region being adapted for venting gas through said filter between said ingredients chamber and said extraction chamber.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Figure 1:
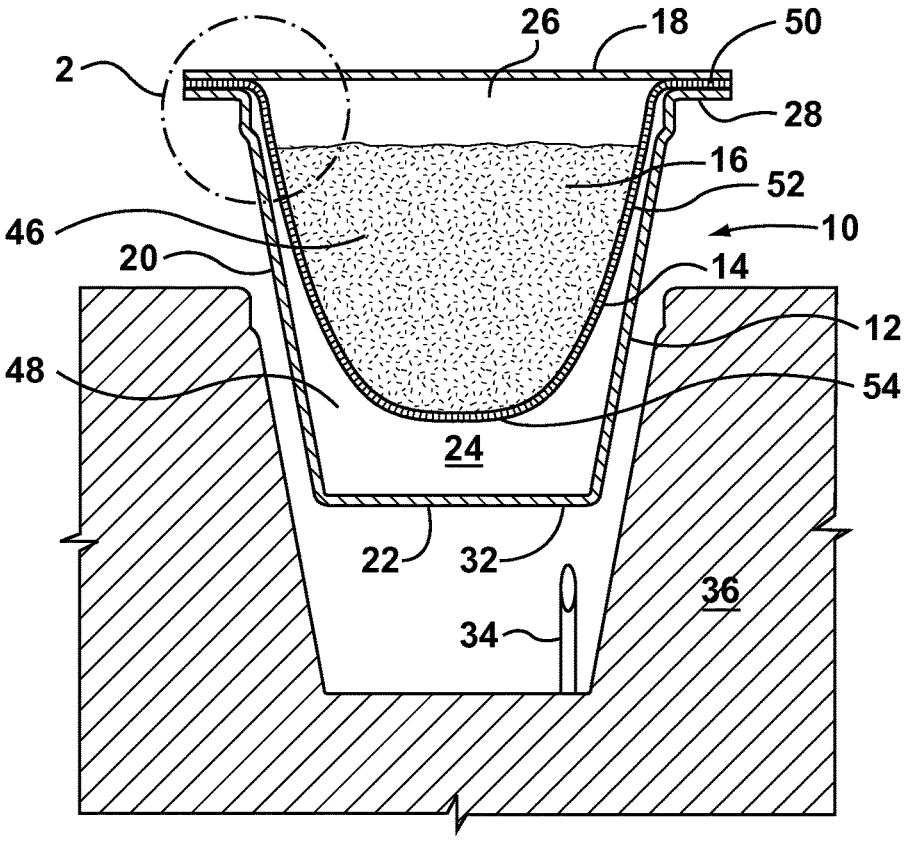
FIG. 1 is a sectional view of a beverage capsule in accordance with the present invention, the beverage capsule being inserted into a brew chamber for a beverage preparing machine.

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A beverage capsule in accordance with the present invention is shown generally at 10 in the Figures. The term "beverage capsule" is intended to mean a capsule for preparing beverages or other consumable products from desired ingredients as described below.

Beverage capsule 10 includes a body 12, filter 14, ingredients 16 and cover 18. Body 12 and cover 18 are each formed of multilayered materials that include one or more barrier layers providing barriers against one or more environmental factors such as light, oxygen, and moisture.

Body 12 includes a side wall 20 and an end wall 22 together defining an enclosed interior space 24. Interior space 24 preferably has a volume in the range of 30 cc to 100 cc for preparing a single serving of beverage and more preferably a volume in the range of 40 cc to 80 cc.

An opening 26 is defined at one end of body 12. A flange 28 extends around the perimeter of opening 26. End wall 22 includes at least one extraction region 32 adapted for being pierced by at least one extraction needle 34 of a beverage preparing machine 36 for dispensing beverage from the capsule 10 to a user's cup.

Filter 14 is adapted to be disposed within body 12 to define at least one ingredients chamber 46 in an upper region of the interior space 24 for receiving one or more ingredients 16 and at least one extraction chamber 48 exterior to the ingredients chamber 46 in the interior space 24 for receiving beverage from the at least one ingredients chamber 46 prior to extraction using the extraction needle 34.

Ingredients 16 may be coffee grounds, tea leaves, chocolate powder, milk powder, instant coffee or any other ingredients or combinations of ingredients that may be used to prepare a beverage or other consumable product. Ingredients requiring filtration (such as coffee grounds or tea leaves) would be deposited within ingredients chamber 46. Ingredients that do not require filtration may be deposited within extraction chamber 48.

Filter 14 includes a gasket portion 50 and a side wall 52 that extends downwardly from gasket portion 50 to a filter bottom 54. Gasket portion 50 is secured to a top surface 55 of flange 28 preferably by way of a heat seal. Cover 18 is subsequently secured to gasket portion 50 of filter 14 and the top surface 55 of flange 28 of body preferably by way of a heat seal. More details of filter 14 and the manner for securing filter 14 and cover 18 to flange 28 of body 12 are provided in co-pending patent application Ser. No. 13/600,582 which is incorporated in its entirety herein by reference. Alternatively, filter 14 may for example be secured to the interior surface of side wall 20 of body 12 and cover 18 may be secured to the top surface 55 of flange 28 using conventional attachment methods.

Figure 2:
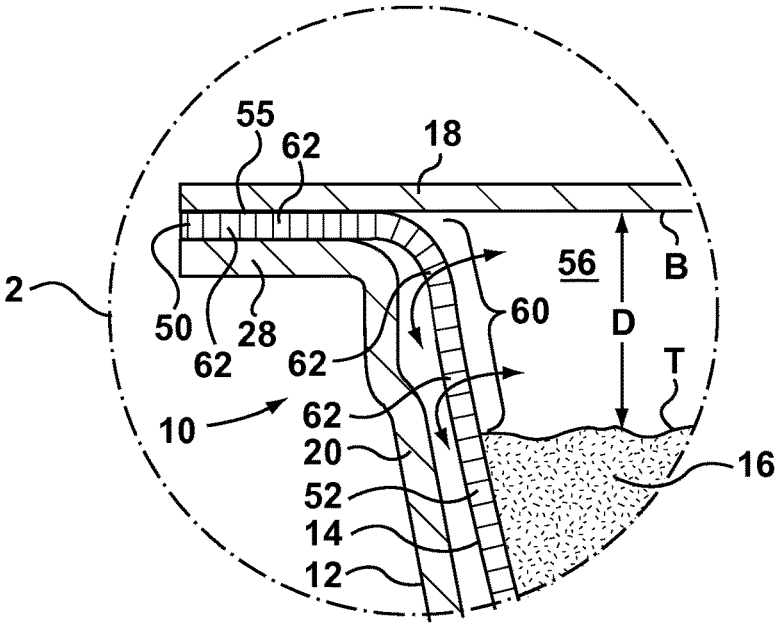
FIG. 2 is an enlarged sectional view of the beverage capsule shown in FIG. 1 as viewed within circle 2.

Referring to the enlarged view of beverage capsule 10 in FIG. 2, ingredients 16 are disposed in ingredients chamber 46 with the top surface T of ingredients 16 being spaced a distance D from the bottom surface B of cover 18. A headspace cavity 56 having a volume of between 3 cc to 18 cc and preferably between 5 cc to 10 cc is defined between top surface T of ingredients 16 and bottom surface B of cover 18. The ratio of the volume of headspace cavity 56 to overall volume of interior space 24 preferably is in the range of 5% to 35% and more preferably 10% to 20%.

A vent region 60 is defined by the portion of side wall 52 of filter 14 that is available for venting (and thus not sealed to body 12) between top surface T of ingredients 16 and bottom surface B of cover 18. Vent region 60 provides a primary region for the venting of gas (such as air and inert gas) through filter 14 between ingredients chamber 46 and extraction chamber 48. Such venting occurs during the MAP process as well as during use of beverage capsule 10 in a beverage preparing machine as pressure differentials between the ingredients chamber 46 and extraction chamber 48 are changing. For a beverage capsule 10 having an interior space 24 adapted for providing a single serving of beverage, vent region 60 preferably has a surface area in the range of 3 to 20 $cm^2$ and more preferably between 6 to 15 $cm^2$.

Filter 14, and in particular vent region 60 of filter 14, preferably has an air permeability of at least 400 L/s·m2, more preferably at least 1000 L/s·m2 and even more preferably at least 1800 L/s·m2 (all measurements based on ASTM Standard D737-96 "Standard Test Method for Air Permeability of Textile Fabrics"). By comparison, the pleated paper filter for the Keurig K-cup beverage capsule having a basis weight of 40 grams per square meter (gsm) has an air permeability of approximately 250 L/s·m2.

Preferably, filter 14 is formed of a non-woven fabric filtration material such as polyester, polyethylene or nylon non-woven fabric. The basis weight for filter 14 is in the range of 40 to 150 gsm and more preferably between 80 to 120 gsm.

Figure 3:
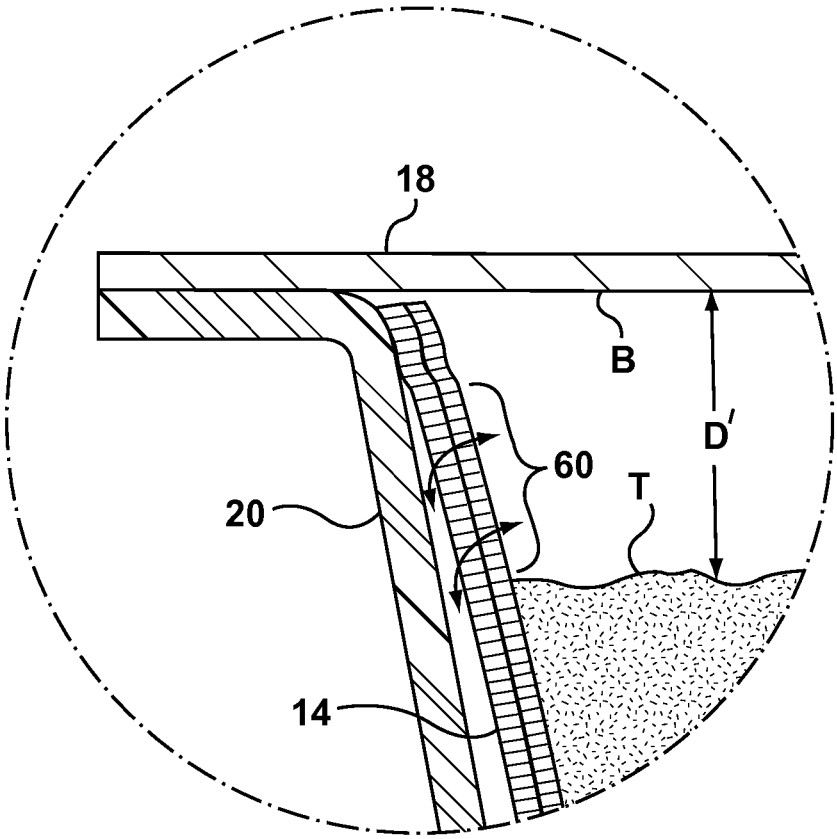
FIG. 3 (Prior Art)
FIG. 3 is an enlarged sectional view of a Keurig K-cup™ beverage capsule (Prior Art) corresponding to the view of the beverage capsule shown in FIG. 2.

Referring to FIG. 3 showing a corresponding enlarged view of a Keurig K-cup™ capsule, it can be seen that the paper filter is adhered to the interior side wall of the capsule with the result that vent region 60 is disposed further down from cover 18 than for the beverage capsule in accordance with an embodiment of the present invention. As a result, the distance D between the top surface T of ingredients 16 and bottom surface B of cover 18 for the beverage capsule in accordance with an embodiment of the present invention may be smaller than distance D' for the Keurig K-Cup™ capsule. This in turn allows for the ingredients to be filled to a higher level for the beverage capsule 10 in accordance with an embodiment of the present invention and thus a greater volume of ingredients to be disposed in the same size beverage capsule 10 if desired. Preferably distance D can be as small as 5 mm and more preferably as small as 2 mm.

Preferably, filter 14 is formed of a moldable non-woven filtration material that includes a plurality of multi-component fibers that are bound or interlocked by non-woven manufacturing techniques (such as spun bond techniques) to form a web having channels 62 extending from one side of filter 14 to the other. The desired diameter for channels 62 after forming is between 20 and 100 μm, more preferably between 40 to 80 μm. More details of a preferred filtration material for filter 14 are provided in co-pending patent application Ser. No. 14/074,024 which is incorporated in its entirety herein by reference.

Filter 14 may alternatively be formed of a polymer sheet, such as polyester or Nylon, which may be perforated or otherwise modified to define channels 62.

Filter 14 may alternatively be formed from an ultra high molecular weight polyethylene (UHWMPE) which is also a filter material due to the cavities/pores formed during polymerization.

Figure 4:
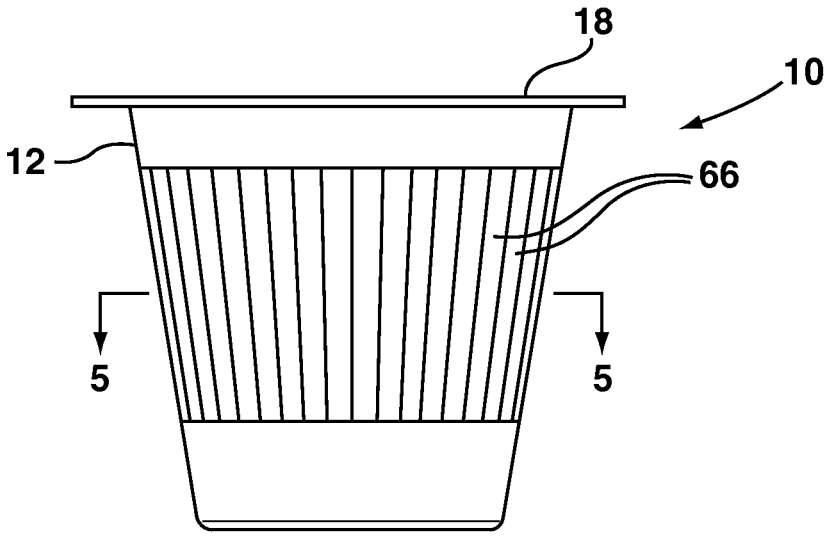
FIG. 4 is a front view of another embodiment of beverage capsule in accordance with the present invention.
Figure 5:
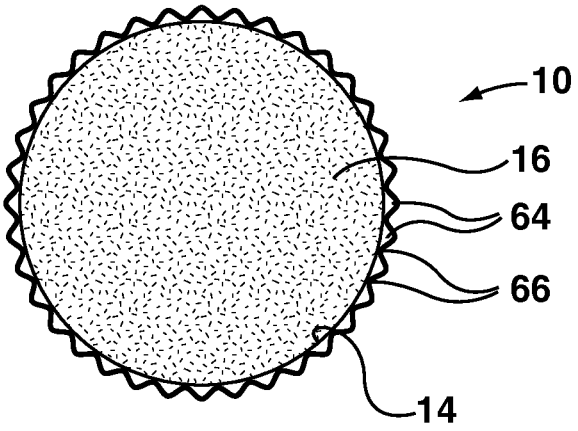
FIG. 5 is a sectional view of the beverage capsule shown in FIG. 4 as viewed along lines 5-5.

In an alternative embodiment as shown in FIGS. 4 and 5, body 12 may have air flow channels 64 and ribs 66 defined in the interior surface of sidewall 20 extending at least partway between opening 16 and end wall 22. Preferably, air flow channels 64 are located at least along an upper portion of sidewall 20 adjacent to vent region 60 of filter 14.

Air flow channels 64 are adapted to provide improved air flow within the beverage capsule 10 along sidewall 20 of body 12 between ingredients chamber 46 and extraction chamber 48 particularly at vent area 60. Air flow channels 64 are adapted to improve air flow sufficiently along the sidewall 20, particularly adjacent vent region 60, to allow a filter 14 having a lower level of air permeability (including conventional paper filters) to be utilized.

Figure 6:
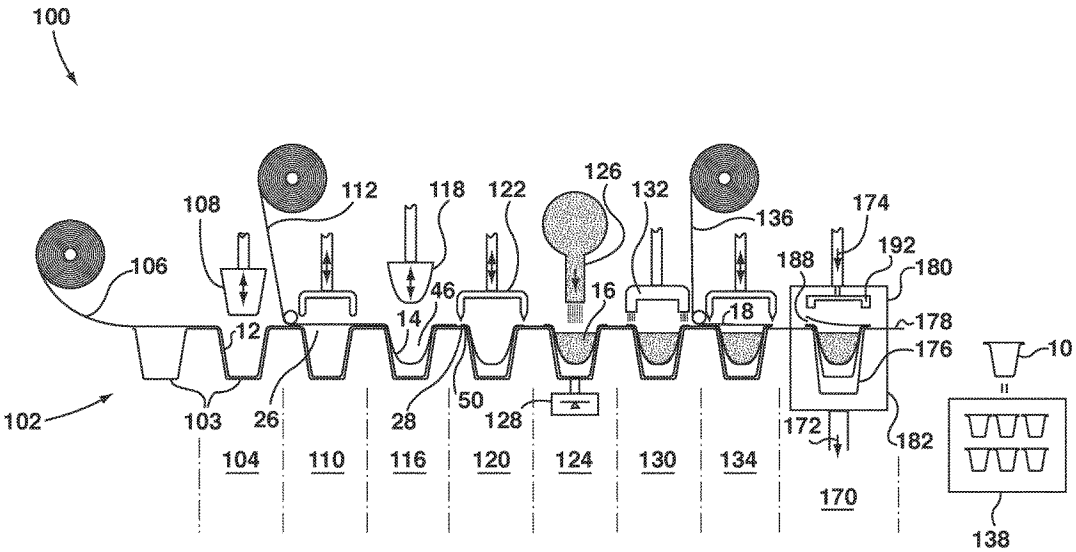
FIG. 6 is a schematic sectional view of a system and process for making beverage capsules in accordance with the present invention

Referring to FIG. 6, a schematic view of a system 100 and process for making beverage capsules 10 in accordance with the present invention is shown.

System 100 comprises at least one transfer belt 102 having a plurality of capsule holders 103 adapted to cyclically and sequentially transfer capsules 10 from a working station to a following station as described further below. While only a single capsule holder 103 is shown at each station for system 100 it will be understood that transfer belt 102 has multiple capsule holders 103 disposed at each station in order that manufacturing operations may be performed simultaneously on multiple capsules at each station.

System 100 includes a body forming station 104 for engaging a sheet of moldable multilayered body material 106 with a heated mandrel 108 to form body 12. Capsule holder 103 with body 12 formed in body material 106 is then transferred to a filter sealing station 110. A sheet of moldable nonwoven filter material 112 is sealed to body material 106 at filter sealing station 110 such that filter material 112 covers opening 26 of body 12.

Capsule holder 103 with filter material 112 sealed to body material 106 is then transferred to a filter forming station 116 where a heated mandrel 118 engages the portion of filter material 112 that extends over opening 26 of body 12 to form a filter 14 into a desired shape to define an ingredients chamber 46 within thermoformed body 12.

Capsule holder 103 with filter material 112 sealed to body material 106 and filter 14 formed in body 12 is then transferred to a cutting station 120 where a die 122 cuts each individual body 12 with filter 14 from body material 106. Die 122 is adapted to cut body material 106 to define flange 28 around opening of body 12 with a gasket portion 50 of filter 14 sealed to the top surface of flange 28.

Capsule holder 103 with separated body 12 with filter 14 is then transferred to a dosing station 124 having an ingredients supplier 126 for supplying a desired amount of ingredients 16 into ingredients chamber 46. A scale 128 weighs beverage capsule 10 to ensure that the desired amount of ingredients 16 have been dosed into ingredients chamber 46.

Capsule holder 103 then transfers body 12 with filter 14 and ingredients 16 to cleaning station 130 where a vacuum conduit 132 cleans the exposed surface of gasket portion 50 of filter 14 in preparation for sealing with cover 18.

Capsule holder 103 then transfers body 12 with filter 14 and ingredients 16 to a cover pre-sealing station 134 for receiving a supply of a cover material 136 and pre-sealing a portion of cover 18 to gasket portion 50 of filter 14 and to flange 28 of body 12. Cover pre-sealing station 134 leaves openings 188 along edge of cover 18 for allowing air to be evacuated and inert gas to be flushed into capsule during the MAP process as described in more detail below.

Partially sealed beverage capsules 10 are then transferred from capsule holders 103 in transfer plate 102 to corresponding capsule holders 176 disposed within a transfer plate 178 using a pick-and-place device (not shown) or other suitable mechanism. Capsule holders 176 and transfer plate 178 are specially adapted for use during the MAP process as described further below.

Transfer plate 178 with partially sealed beverage capsules 10 disposed in capsule holders 176 is then moved to a MAP station 170 for execution of the MAP process as described below. Once the MAP process is complete, openings 188 in cover 18 are sealed with sealer 192 and the finished beverage capsule 10 is transferred using a pick-and-place device (not shown) or other suitable mechanism to a collection station 138 for subsequent packaging into boxes (not shown).

Figure 7:
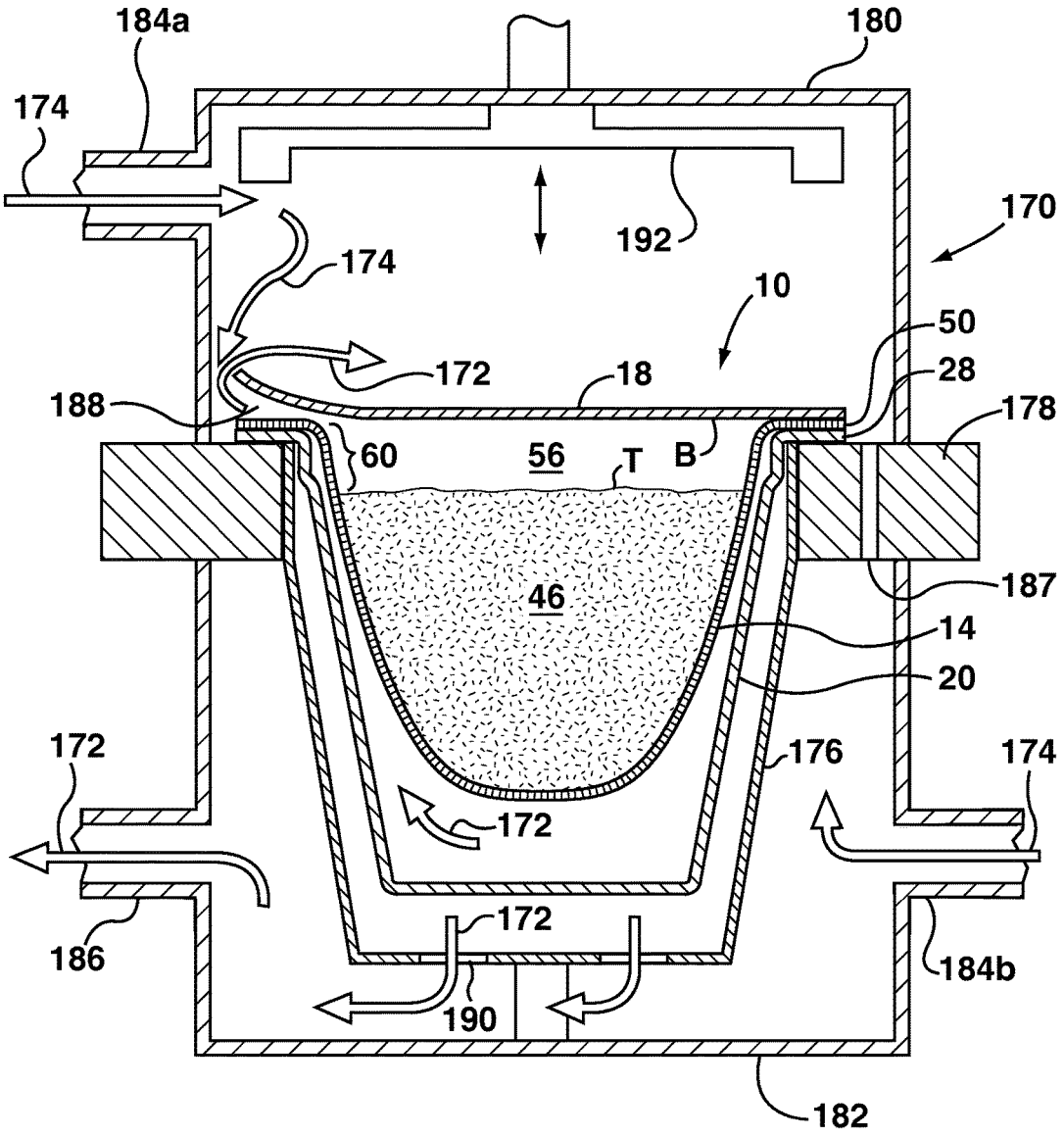
FIG. 7 is a schematic sectional view of a MAP station containing beverage capsules for modified atmosphere packaging in accordance with the present invention.

Referring to FIG. 7, MAP station 170 that is adapted for replacing air 172 within beverage capsule 10 with a desired inert gas 174 is shown. MAP station 170 is sized and configured to accommodate multiple beverage capsules 10 disposed in multiple capsule holders 176 supported along a row by the transfer plate 178. The transfer plate 178 is adapted to be transferred to and from MAP station 170 as part of the overall manufacturing process as described above.

MAP station 170 comprises an upper chamber 180 and a lower chamber 182 that each move between an open position (not shown), where upper chamber 180 and lower chamber 182 are spaced a sufficient distance apart in order that transfer plate 178 containing beverage capsules 10 may be transferred to or from MAP station 170, and a closed position, where upper chamber 180 and lower chamber 182 form an airtight seal against transfer plate 178 in order that the MAP process may be conducted.

Upper chamber 180 includes a first inert gas inlet 184*a* connected to a source (not shown) of a desired inert gas 174, such as nitrogen or carbon dioxide, for supplying inert gas 174 under pressure to upper chamber 180. Lower chamber 182 includes a second inert gas inlet 184*b* connected to a source (not shown) of a desired inert gas 174, such as nitrogen or carbon dioxide, for supplying inert gas 174 under pressure to lower chamber 182.

Lower chamber 182 further includes an outlet 186 connected to a vacuum generator (not shown) for creating a vacuum within MAP station 170 when it is in its closed position for removing air from upper and lower chambers 180 and 182 as well as interior space 24 of beverage capsules 10 contained within MAP station 170.

Figure 8:
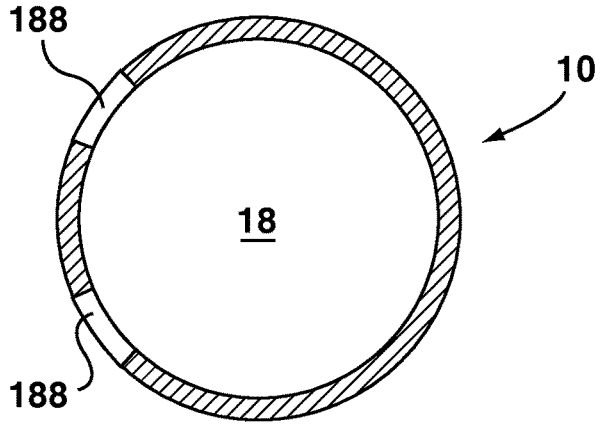
FIG. 8 is a top view of a beverage capsule with a substantially sealed cover having access openings in accordance with the present invention.

Referring to FIG. 8, beverage capsule 10 has a portion of cover 18 that is sealed to gasket portion 50 of filter and flange 28 of body 12 and at least one portion of cover 18 that is left unsealed to provide at least one opening 188 for air 172 to be drawn out of beverage capsule and inert gas 174 to be supplied into beverage capsule 10. Preferably at least two openings 188 are provided at cover 18 with each opening 188 occupying at least 10% and preferably at least 20% of the circumference of flange to provide sufficient space for air 172 or inert gas 174 to flow efficiently through openings 188.

Referring back to FIG. 7, port 187 extends through transfer plate 178 to permit air 172 and inert gas 174 to flow between upper chamber 180 and lower chamber 182 during the performance of the MAP process. Capsules 10 are preferably disposed in capsule holders 176 with openings 188 being located on the side of transfer plate that is opposite to the location of port 187 in order that the flow of air 172 urges the unsealed portion of cover 18 away from flange to expose openings 188.

Figure 9:
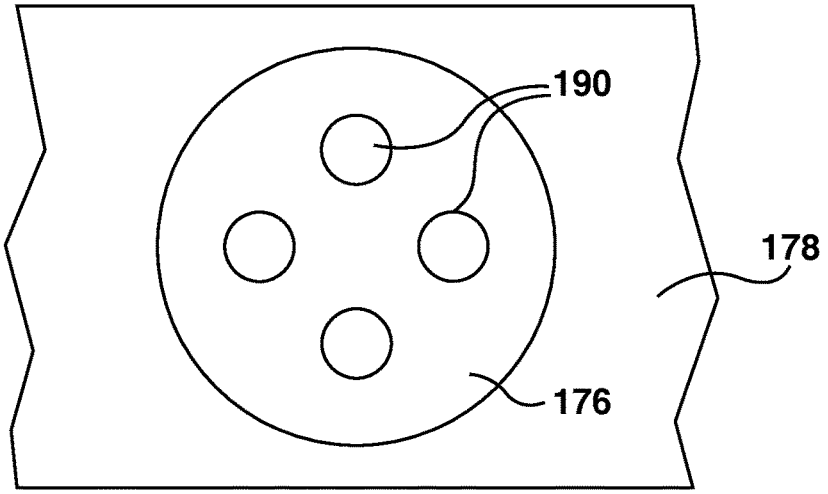
FIG. 9 is a top view of the lower chamber of the MAP station showing the vacuum portals.

As shown in FIG. 9, a plurality of openings 190 are defined in the base of capsule holder 176 to allow the vacuum created in lower chamber 182 to also draw air from within capsule holder 176 as well as from within beverage capsule 10. Thus air 172 is drawn from beverage capsule 10 through openings 188 in cover 18 into lower chamber 182 through port 187 and out to vacuum generator through outlet 186.

MAP station 170 further includes a heat sealer 192 that is adapted to be moved into engagement with the edge portion of cover 18 over flange 28 once the MAP process is complete to close openings 188 and fully seal cover 18 to gasket portion 50 of filter 14 and flange 28 of body 12.

Figure 10:
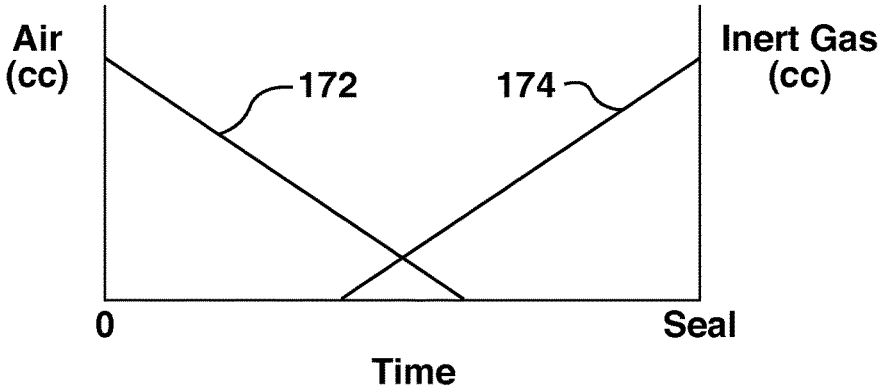
FIG. 10 is a graph depicting the modified atmospheric packaging process in accordance with the present invention.

Referring to FIG. 10, it may be seen that air 172 is initially withdrawn from beverage capsule 10 prior to initiating the supply of inert gas 74. It may be seen that the supply of inert gas 174 is initiated after a predetermined period for removal of air within MAP station 170 including from within beverage capsule 10. It may also be seen that the supply of inert gas 174 is started before the air removal finished in order to minimize the gas turbulence in the evacuation process Once sufficient air 172 is removed from beverage capsule 10 and replaced with inert gas 174, the openings 188 in cover 18 are sealed with sealer 192 to fully seal the interior space 24 of beverage capsule 10. It is desirable that sufficient air 172 is removed from beverage capsule 10 to provide an oxygen level of less than 2% and more preferably less than 1%.

Referring to Table 1 below, the preferred parameters for the MAP process and beverage capsule 10 in accordance with the present invention are provided. Advantageously, the MAP process may be conducted more efficiently and at a greater rate of production than for conventional beverage capsules such as Keurig K-cup™ beverage capsules.

TABLE 1

MAP Station Parameters

| Function | Parameters | Preferred range | More preferred range |
|---|---|---|---|
| Vacuum | Pressure | 5-100 KPa | 10-80 KPa |
| | Time | 0.5-4 sec | 1-3 sec |
| Inert gas | Pressure | 20-300 KPa | 50-150 KPa |
| supply | Time | 0.02-1.5 sec | 0.1-1 sec |
| Sealing | Pressure | 100-800 KPa | 300-600 Kpa |
| | Time | 0.2-2 sec | 0.5-1.2 sec |
| | Temp | 120-250° C. | 150-200° C. |

While the above description provides examples of one or more processes or apparatuses, it will be appreciated that other processes or apparatuses may be within the scope of the accompanying claims.

We claim:

1. A system for making a beverage capsule for use in a beverage preparing machine, the system comprising:

a filter sealing station for sealing a filter to a body for the beverage capsule to define an ingredients chamber and an extraction chamber, said filter having an air flow permeability of at least 400 L/s·m2, said body having a side wall extending from an end wall to an opening to define an interior space having a volume in the range of 30 cc to 100 cc, said opening being surrounded by a flange, wherein a vent region is defined in said filter around said ingredients chamber between a top surface of desired ingredients disposed in said ingredients chamber and a bottom surface of a cover for covering said opening, said vent region being constructed and arranged for venting gas through said filter between said ingredients chamber and said extraction chamber;

a dosing station for depositing a desired volume of said desired ingredients into said ingredients chamber, wherein said top surface of said ingredients disposed in said ingredients chamber is spaced between 2-5 mm from said bottom surface of said cover when said capsule is disposed on said end wall;

a cover pre-sealing station for sealing said cover to said flange while maintaining at least one airflow opening; and a modified atmosphere packaging (MAP) station for replacing a substantial volume of air within said body with an inert gas and sealing said at least one airflow opening with said cover.

2. A system as claimed in claim 1, wherein said vent region has a surface area of no less than 3 $cm^2$.

3. A system as claimed in claim 1, wherein said vent region is disposed between 0-5 mm below said bottom surface of said cover.

4. A system as claimed in claim 1, wherein a headspace cavity having a volume is defined between said top surface of said ingredients in said ingredients chamber and a bottom surface of said cover, and wherein the ratio of said volume of said headspace cavity to the volume of said interior space is in the range of 5% to 35%.

5. A system as claimed in claim 1 further comprising a transfer plate adapted for transferring said capsule containing said desired volume of desired ingredients to said MAP station for execution of said step of replacing a substantial volume of air within said interior space with an inert gas.

6. A system as claimed in claim 1, wherein said air flow permeability is at least 1000 L/s·m2.

7. A system as claimed in claim 1, wherein said filter is sealed to said flange.

8. A system as claimed in claim 1, wherein said filter is formed of a moldable non-woven material.

9. A system as claimed in claim 8, further comprising a filter forming station for forming said moldable non-woven material into a desired shape to define said ingredients chamber.

10. A system for making a beverage capsule for use in a beverage preparing machine, the system comprising:

a filter sealing station for sealing a filter to a body for the beverage capsule to define an ingredients chamber and an extraction chamber, said ingredients chamber being adapted to receive a desired amount of desired ingredients, said body having a side wall extending from an end wall to an opening surrounded by a flange extending outwardly and generally transversely from said side wall to define an interior space that is adapted to be sealed with a cover, said filter being sealed to said flange and said cover being sealed to said filter on said flange, said filter having a vent region defined in a portion of a side wall of said filter that is available for venting around said ingredients chamber between a top surface of said ingredients and a bottom surface of said cover, said vent region being constructed and arranged for venting gas through said filter between said ingredients chamber and said extraction chamber, wherein at least said vent region portion of said filter has an air flow permeability of at least 400 L/s·m2;

a dosing station for depositing a desired volume of desired ingredients into said ingredients chamber;

a cover pre-sealing station for sealing said cover to said filter on said flange while maintaining at least one airflow opening; and a modified atmosphere packaging (MAP) station for replacing a substantial volume of air within said body with an inert gas and sealing said at least one airflow opening with said cover.

11. A system as claimed in claim 10, wherein said interior space has a volume in the range of 30 cc to 100 cc and said vent region has a surface area no less than 3 cm2.

12. A system as claimed in claim 10, wherein said vent region is disposed between 0-5 mm below said bottom surface of cover.

13. A system as claimed in claim 10, wherein the spacing between a top surface of said ingredients disposed in said ingredients chamber and a bottom surface of said cover is between 2-5 mm.

14. A system as claimed in claim 10 wherein said capsule containing said desired volume of desired ingredients is disposed in a transfer plate and transferred to said MAP station for execution of said step of replacing a substantial volume of air within said interior space with an inert gas.

15. A system as claimed in claim 10, wherein said air flow permeability is at least 1000 L/s·m2.

16. A system as claimed in claim 10, wherein said filter is formed of a moldable non-woven material.

17. A system as claimed in claim 16, further comprising a filter forming station for forming said moldable non-woven material into a desired shape to define said ingredients chamber.

18. A system for making a beverage capsule for use in a beverage preparing machine, the system comprising:

a body forming station for forming a body for the beverage capsule from a moldable body material, said body having a side wall extending from an end wall to an opening surrounded by a flange to define an interior space that is adapted to be sealed with a cover, said flange extending outwardly and generally transversely from said side wall;

a filter sealing station for sealing a moldable non-woven material over said opening to said flange;

a filter forming station for forming a filter from said moldable non-woven material to define an ingredients chamber and an extraction chamber, said ingredients chamber being adapted to receive a desired amount of desired ingredients, said filter having a vent region defined in a portion of a side wall of said filter that is available for venting around said ingredients chamber between a top surface of said ingredients and a bottom surface of said cover, said vent region being constructed and arranged for venting gas through said filter between said ingredients chamber and said extraction chamber;

a dosing station for depositing a desired volume of desired ingredients into said ingredients chamber;

a cover pre-sealing station for sealing a cover to said flange while maintaining at least one airflow opening; and a modified atmosphere packaging (MAP) station for replacing a substantial volume of air within said body with an inert gas and sealing said at least one airflow opening with said cover.

19. A system as claimed in claim 18, wherein said cover is sealed to said filter on said flange.

* * * * *